US008215411B2

(12) United States Patent
Flores et al.

(10) Patent No.: US 8,215,411 B2
(45) **Date of Patent: *Jul. 10, 2012**

(54) CLUSTER OPENING SLEEVES FOR WELLBORE TREATMENT AND METHOD OF USE

(75) Inventors: Antonio Bermea Flores, Houston, TX (US); Michael Flores, Powell, WY (US)

(73) Assignee: Weatherford/Lamb, Inc., Houston, TX (US)

( * ) Notice: Subject to any disclaimer, the term of this patent is extended or adjusted under 35 U.S.C. 154(b) by 234 days.

This patent is subject to a terminal disclaimer.

(21) Appl. No.: 12/613,633

(22) Filed: Nov. 6, 2009

(65) Prior Publication Data

US 2011/0108284 A1 May 12, 2011

(51) Int. Cl.
*E21B 34/06* (2006.01)
*E21B 33/12* (2006.01)

(52) U.S. Cl. ..... 166/386; 166/194; 166/373

(58) Field of Classification Search ..... 166/337, 166/386, 194, 318, 332.3
See application file for complete search history.

(56) References Cited

U.S. PATENT DOCUMENTS

| | | | | |
|---|---|---|---|---|
| 4,520,870 | A | 6/1985 | Pringle | |
| 4,823,882 | A | 4/1989 | Stokley et al. | |
| 4,893,678 | A | 1/1990 | Stokley et al. | |
| 5,146,992 | A | 9/1992 | Baugh | |
| 5,224,556 | A | 7/1993 | Wilson et al. | |
| 5,244,044 | A | 9/1993 | Henderson | |
| 5,425,424 | A | 6/1995 | Reinhardt et al. | |
| 5,631,634 | A | 5/1997 | Strelow | |
| 5,960,884 | A * | 10/1999 | Echols | 166/317 |
| 6,041,857 | A | 3/2000 | Carmody et al. | |
| 6,155,350 | A | 12/2000 | Melenyzer | |
| 6,349,766 | B1 | 2/2002 | Bussear et al. | |
| 6,464,008 | B1 | 10/2002 | Roddy et al. | |
| 6,634,428 | B2 * | 10/2003 | Krauss et al. | 166/317 |
| 6,907,936 | B2 | 6/2005 | Fehr et al. | |
| 6,920,930 | B2 | 7/2005 | Allamon et al. | |
| 7,108,067 | B2 | 9/2006 | Themig et al. | |
| 7,347,289 | B2 | 3/2008 | Lee | |
| 7,387,165 | B2 | 6/2008 | Lopez de Cardenas et al. | |
| 2002/0100596 | A1 * | 8/2002 | Nguyen et al. | 166/382 |
| 2003/0127227 | A1 * | 7/2003 | Fehr et al. | 166/306 |
| 2007/0272411 | A1 | 11/2007 | Lopez de Cardenas et al. | |
| 2008/0093080 | A1 | 4/2008 | Palmer et al. | |
| 2009/0084553 | A1 | 4/2009 | Rytlewski et al. | |

OTHER PUBLICATIONS

Halliburton brochure; Completion Tools, "Delta Stim Sleeve: Designed for Selective Multi-Zone Fracturing or Acidizing Through the Completion," H04616, Sep. 2008.

(Continued)

*Primary Examiner* — Cathleen Hutchins
(74) *Attorney, Agent, or Firm* — Wong, Cabello, Lutsch, Rutherford & Bruculerri, LLP

(57) ABSTRACT

A downhole sleeve has a sliding sleeve movable in a bore of the sleeve's housing. The sliding sleeve is movable from a closed condition to an opened condition when a ball is dropped in the sleeve's bore and engages an indexing seat in the sliding sleeve. The sliding sleeve in the closed condition prevents communication between the bore and the port, and the sleeve in the opened condition permits communication between the bore and the port. In the closed condition, keys of the seat extend into the bore to engage the ball and to move the sliding sleeve open. In the opened condition, the keys of the seat retract from the bore so the ball can pass through the sleeve to another cluster sleeve or to another isolation sleeve of an assembly.

35 Claims, 4 Drawing Sheets

OTHER PUBLICATIONS

Halliburton brochure; Service Tools, "Delta Stim Lite Sleeve: Designed for Selective Multi-Zone Fracturing or Acidizing Through the Completion," H06033, Jul. 2009.
DSI Brochure; "PBL-Multiple Activation Autolock Bypass Systems," obtained from http://www.dsi-pbl.com, undated.
DSI, "Autolock Bypass System," obtained from http://www.dsi-pbl.com/, generated on Oct. 28, 2009.
DSI, "Autolock Bypass System—application," obtained from http://www.dsi-pbl.com/, generated on Oct. 28, 2009.
DSI Brochure, "PBL Multiple Activation Autolock Bypass System," obtained from http://www.dsi-pbl.com/, undated.
Weatherford Brochure, "WXO and WXA Standard Sliding Sleeves," 4603.02, copyrighted 2007-2008.
First Office Action in copending U.S. Appl. No. 13/087,635, mailed Sep. 27, 2011.
Reply to First Office Action in copending U.S. Appl. No. 13/087,635, filed Dec. 27, 2011.
Final Office Action in copending U.S. Appl. No. 13/087,635, mailed Mar. 12, 2012.
Reply to Final Office Action in copending U.S. Appl. No. 13/087,635, filed Apr. 7, 2012.
Notice of Protest in counterpart Canadian Appl. No. 2,716,834, mailed Mar. 20, 2012.
First Requisition in counterpart Canadian Appl. No. 2,716,834, mailed Mar. 28, 2012.
First Office Action in counterpart Canadian Appl. No. 2,716,834, mailed Mar. 28, 2012.
Notice of Allowance in copending U.S. Appl. No. 13/087,635, mailed Apr. 19, 2012.

* cited by examiner

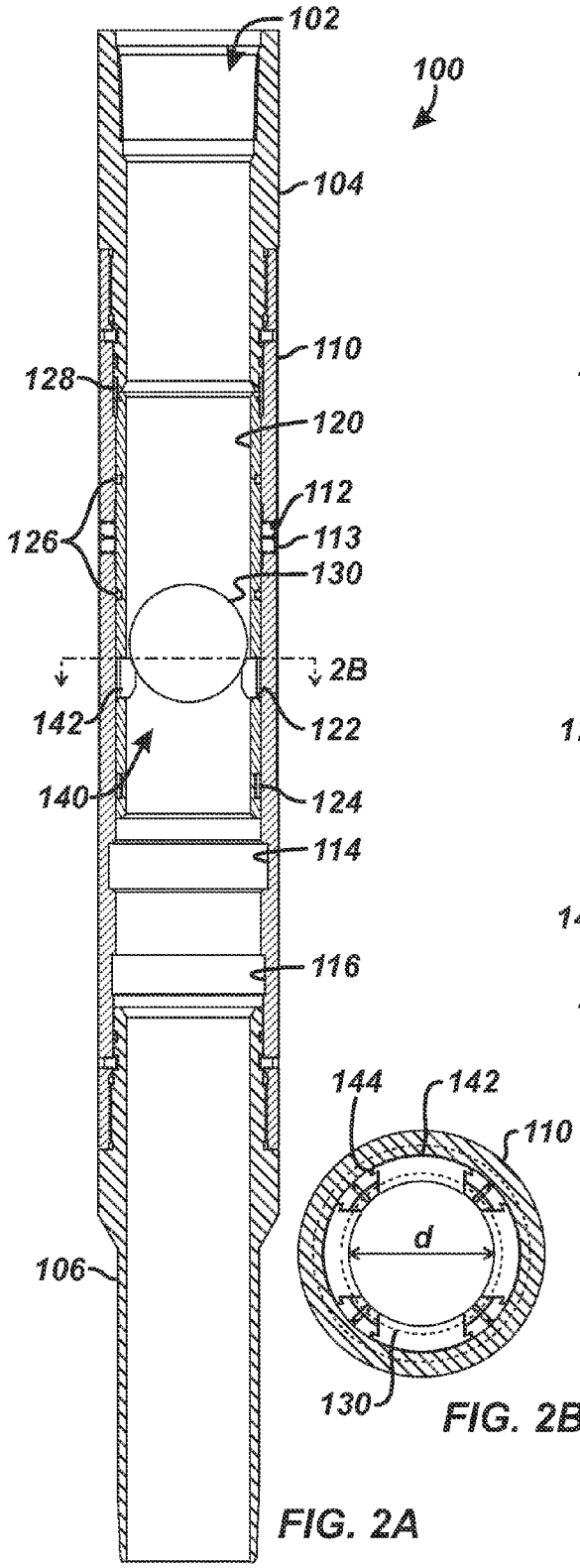
FIG. 2A
FIG. 2B
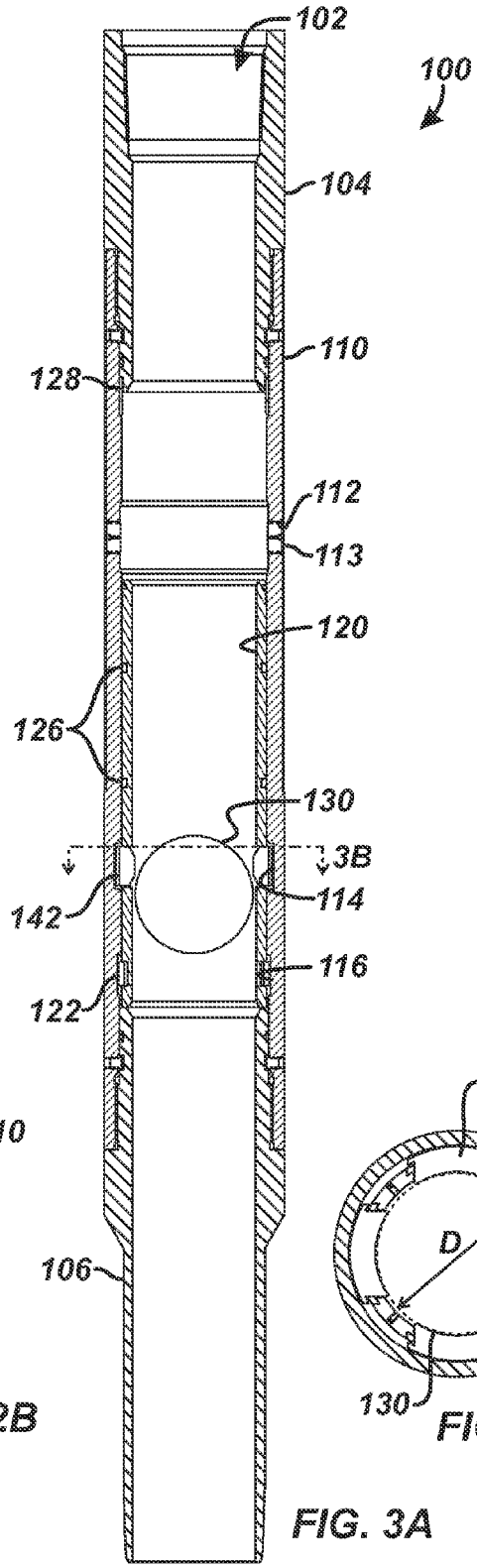
FIG. 3A
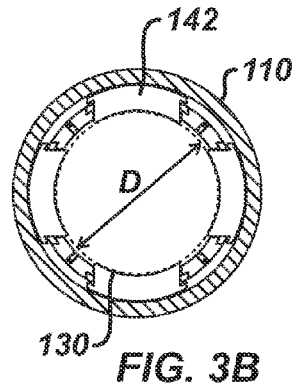
FIG. 3B

CLUSTER OPENING SLEEVES FOR WELLBORE TREATMENT AND METHOD OF USE

BACKGROUND

In a staged frac operation, multiple zones of a formation need to be isolated sequentially for treatment. To achieve this, operators install a frac assembly down the wellbore. Typically, the assembly has a top liner packer, open hole packers isolating the wellbore into zones, various sliding sleeves, and a wellbore isolation valve. When the zones do not need to be closed after opening, operators may use single shot sliding sleeves for the frac treatment. These types of sleeves are usually ball-actuated and lock open once actuated. Another type of sleeve is also ball-actuated, but can be shifted closed after opening.

Initially, operators run the frac assembly in the wellbore with all of the sliding sleeves closed and with the wellbore isolation valve open. Operators then deploy a setting ball to close the wellbore isolation valve. This seals off the tubing string so the packers can be hydraulically set. At this point, operators rig up fracturing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

Because the zones are treated in stages, the lowermost sliding sleeve has a ball seat for the smallest sized ball size, and successively higher sleeves have larger seats for larger balls. In this way, a specific sized dropped ball will pass though the seats of upper sleeves and only locate and seal at a desired seat in the tubing string. Despite the effectiveness of such an assembly, practical limitations restrict the number of balls that can be run in a single tubing string. Moreover, depending on the formation and the zones to be treated, operators may need a more versatile assembly that can suit their immediate needs.

The subject matter of the present disclosure is directed to overcoming, or at least reducing the effects of, one or more of the problems set forth above.

SUMMARY

A cluster of sliding sleeve deploys on a tubing sting in a wellbore. Each sliding sleeve has an inner sleeve or insert movable from a closed condition to an opened condition. When the insert is in the closed condition, the insert prevents communication between a bore and a port in the sleeve's housing. To open the sliding sleeve, a plug (ball, dart, or the like) is dropped into the sliding sleeve. When reaching the sleeve, the ball engages a corresponding seat in the insert to actuate the sleeve from the closed condition to the opened condition. Keys or dogs of the insert's seat extend into the bore and engage the dropped ball, allowing the insert to be moved open with applied fluid pressure. After opening, fluid can communicates between the bore and the port.

When the insert reaches the closed condition, the keys retract from the bore and allows the ball to pass through the seat to another sliding sleeve deployed in the wellbore. This other sliding sleeve can be a cluster sleeve that opens with the same ball and allows the ball to pass therethrough after opening. Eventually, however, the ball can reach an isolation sleeve deployed on the tubing string that opens when the ball engages its seat but does not allow the ball to pass therethrough. Operators can deploy various arrangements of cluster and isolation sleeves for different sized balls to treat desired isolated zones of a formation.

The foregoing summary is not intended to summarize each potential embodiment or every aspect of the present disclosure.

BRIEF DESCRIPTION OF THE DRAWINGS

FIG. 2A illustrates an axial cross-section of a cluster sliding sleeve according to the present disclosure in a closed condition.

FIG. 2B illustrates a lateral cross-section of the cluster sliding sleeve in FIG. 2A.

FIG. 3A illustrates another axial cross-section of the cluster sliding sleeve in an open condition.

FIG. 3B illustrates a lateral cross-section of the cluster sliding sleeve in FIG. 3A.

DETAILED DESCRIPTION

Figure 1:
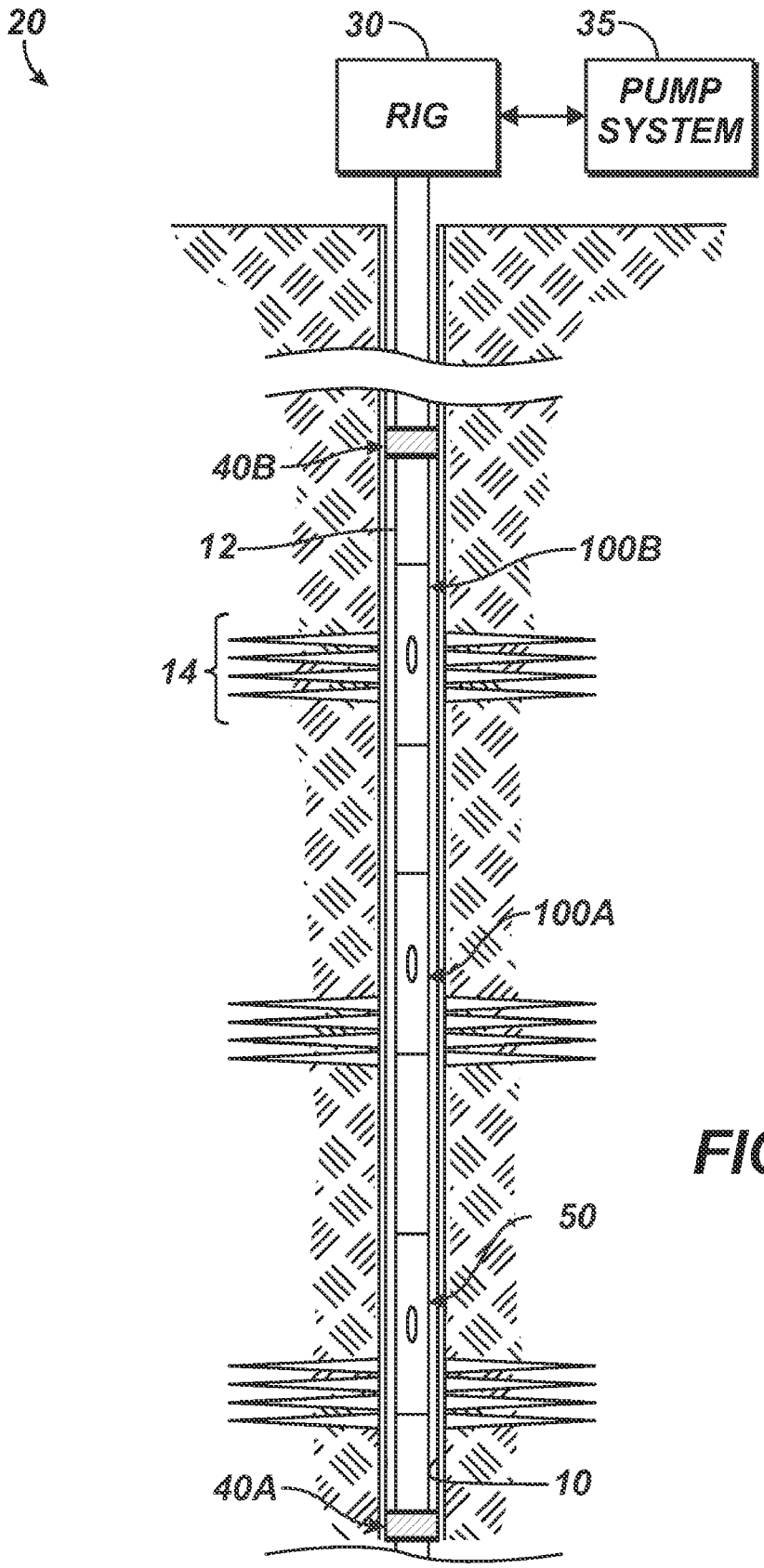
FIG. 1 diagrammatically illustrates a tubing string having multiple sleeves according to the present disclosure.

A tubing string 12 shown in FIG. 1 deploys in a wellbore 10. The string 12 has an isolation sliding sleeve 50 and cluster sliding sleeves 100A-B disposed along its length. A pair of packers 40A-B isolate portion of the wellbore 10 into an isolated zone. In general, the wellbore 10 can be an opened or cased hole, and the packers 40A-B can be any suitable type of packer intended to isolate portions of the wellbore into isolated zones. The sliding sleeves 50 and 100A-B deploy on the tubing string 12 between the packers 40A-B and can be used to divert treatment fluid to the isolated zone of the surrounding formation.

The tubing string 12 can be part of a frac assembly, for example, having a top liner packer (not shown), a wellbore isolation valve (not shown), and other packers and sleeves (not shown) in addition to those shown. The wellbore 10 can have casing perforations 14 at various points. As conventionally done, operators deploy a setting ball to close the wellbore isolation valve, rig up fracturing surface equipment, pump fluid down the wellbore, and open a pressure actuated sleeve so a first zone can be treated. Then, in a later stage of the operation, operators actuate the sliding sleeves 50 and 100A-B between the packers 40A-B to treat the isolated zone depicted in FIG. 1.

Briefly, the isolation sleeve 50 has a seat (not shown). When operators drop a specifically sized plug (e.g., ball, dart, or the like) down the tubing string 12, the plug engages the isolation sleeve's seat. (For purposes of the present disclosure, the plug is described as a ball, although the plug can be any other acceptable device.) As fluid is pumped by a pump system 35 down the tubing string 12, the seated ball opens the isolation sleeve 50 so the pumped fluid can be diverted out ports to the surrounding wellbore 10 between packers 40A-B.

In contrast to the isolation sleeve 50, the cluster sleeves 100A-B have corresponding seats (not shown) according to the present disclosure. When the specifically sized ball is dropped down the tubing string 12 to engage the isolation sleeve 50, the dropped ball passes through the cluster sleeves 100A-B, but opens these sleeves 100A-B without permanently seating therein. In this way, one sized ball can be dropped down the tubing string 12 to open a cluster of sliding sleeves 50 and 100A-B to treat an isolated zone at particular points (such as adjacent certain perforations 14).

Figure 4:
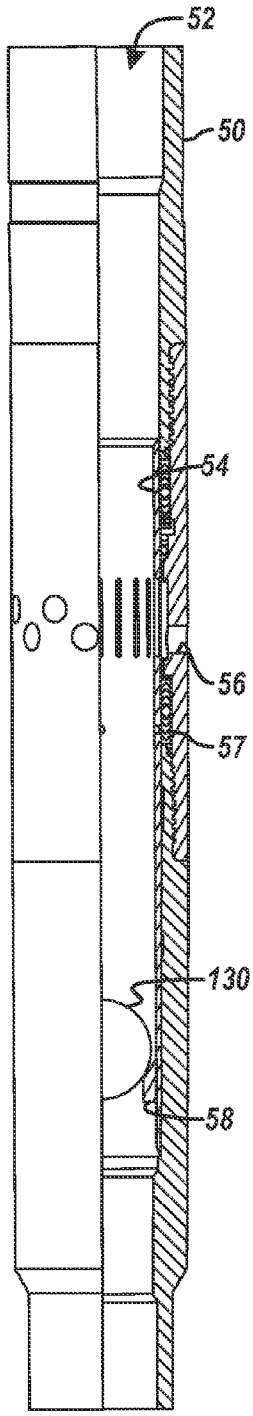
FIG. 4 illustrates an axial cross-section of an isolation sliding sleeve according to the present disclosure in an opened condition.

With a general understanding of how the sliding sleeves 50 and 100 are used, attention now turns to details of a cluster sleeve 100 shown in FIGS. 2A-2B and FIGS. 3A-3B and an isolation sleeve 50 shown in FIG. 4.

Turning first to FIGS. 2A through 3B, the cluster sleeve 100 has a housing 110 defining a bore 102 therethrough and having ends 104/106 for coupling to a tubing string. Inside the housing 110, an inner sleeve or insert 120 can move from a closed condition (FIG. 2A) to an open condition (FIG. 3A) when an appropriately sized ball 130 (or other form of plug) is passed through the sliding sleeve 100.

In the closed condition (FIG. 2A), the insert 120 covers external ports 112 in the housing 110, and peripheral seals 126 on the insert 120 keep fluid in the bore 102 from passing through these ports 112. In the open condition (FIG. 3A), the insert 120 is moved away from the external ports 112 so that fluid in the bore 102 can pass out through the ports 112 to the surrounding annulus and treat the adjacent formation.

To move the insert 120, the ball 130 dropped down the tubing string from the surface engages a seat 140 inside the insert 120. The seat 140 includes a plurality of keys or dogs 142 disposed in slots 122 defined in the insert 120. When the sleeve 120 is in the closed condition (FIG. 2A), the keys 142 extend out into the internal bore 102 of the cluster sleeve 100. As best shown in the cross-section of FIG. 2B, the inside wall of the housing 110 pushes these keys 142 into the bore 102 so that the keys 142 define a restricted opening with a diameter (d) smaller than the intended diameter (D) of the dropped ball. As shown, four such keys 142 can be used, although the seat 140 can have any suitable number of keys 142. As also shown, the proximate ends 144 of the keys 142 can have shoulders to catch inside the sleeve's slots 122 to prevent the keys 142 from passing out of the slots 122.

When the dropped ball 130 reaches the seat 140 in the closed condition, fluid pressure pumped down through the sleeve's bore 102 forces against the obstructing ball 130. Eventually, the force releases the insert 120 from a catch 128 that initially holds it in its closed condition. As shown, the catch 128 can be a shear ring, although a collet arrangement or other device known in the art could be used to hold the insert 120 temporarily in its closed condition.

Continued fluid pressure then moves the freed insert 120 toward the open condition (FIG. 3A). Upon reaching the lower extremity, a lock 124 disposed around the insert 120 locks the insert 120 in place. For example, the lock 124 can be a snap ring that reaches a circumferential slot 116 in the housing 110 and expands outward to lock the insert 120 in place. Although the lock 124 is shown as a snap ring 124 is shown, the insert 120 can use a shear ring or other device known in the art to lock the insert 120 in place.

When the insert 120 reaches its opened condition, the keys 124 eventually reach another circumferential slot 114 in the housing 110. As best shown in FIG. 3B, the keys 124 retract slightly in the insert 120 when they reach the slot 114. This allows the ball 130 to move or be pushed past the keys 124 so the ball 130 can travel out of the cluster sleeve 100 and further downhole (to another cluster sleeve or an isolation sleeve).

When the insert 120 is moved from the closed to the opened condition, the seals 126 on the insert 120 are moved past the external ports 112. A reverse arrangement could also be used in which the seals 126 are disposed on the inside of the housing 110 and engage the outside of the insert 120. As shown, the ports 112 preferably have insets 113 with small orifices that produce a pressure differential that helps when moving the insert 120. Once the insert 120 is moved, however, these insets 113, which can be made of aluminum or the like, are forced out of the port 112 when fluid pressure is applied during a frac operation or the like. Therefore, the ports 112 eventually become exposed to the bore 102 so fluid passing through the bore 102 can communicate through the exposed ports 112 to the surrounding annulus outside the cluster sleeve 100.

As noted previously, the dropped ball 130 can pass through the sleeve 100 to open it so the ball 130 can pass further downhole to another cluster sleeve or to an isolation sleeve. In FIG. 4, an isolation sleeve 50 is shown in an opened condition. The isolation sleeve 50 defines a bore 52 therethrough, and an insert 54 can be moved from a closed condition to an open condition (as shown). The dropped ball 130 with its specific diameter is intended to land on an appropriately sized ball seat 56 within the insert 54. Once seated, the ball 130 typically seals in the seat 56 and does not allow fluid pressure to pass further downhole from the sleeve 50. The fluid pressure communicated down the isolation sleeve 50 therefore forces against the seated ball 130 and moves the insert 54 open. As shown, openings in the insert 54 in the open condition communicate with external ports 56 in the isolation sleeve 50 to allow fluid in the sleeve's bore 52 to pass out to the surrounding annulus. Seals 57, such as chevron seals, on the inside of the bore 52 can be used to seal the external ports 56 and the insert 54. One suitable example for the isolation sleeve 50 is the Single-Shot ZoneSelect Sleeve available from Weatherford.

Figure 5A:
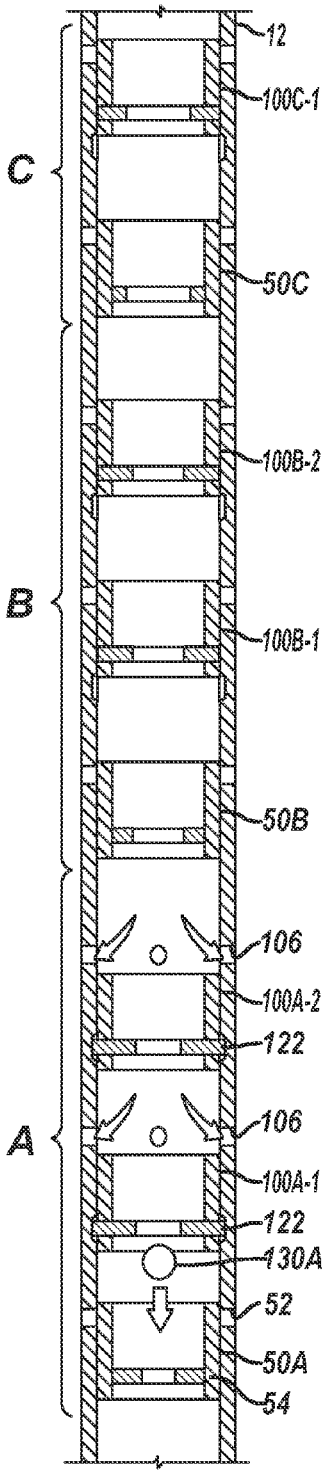
FIGS. 5A-5C schematically illustrate an arrangement of cluster sliding sleeves and isolation sliding sleeves in various stages of operation.
Figure 5B:
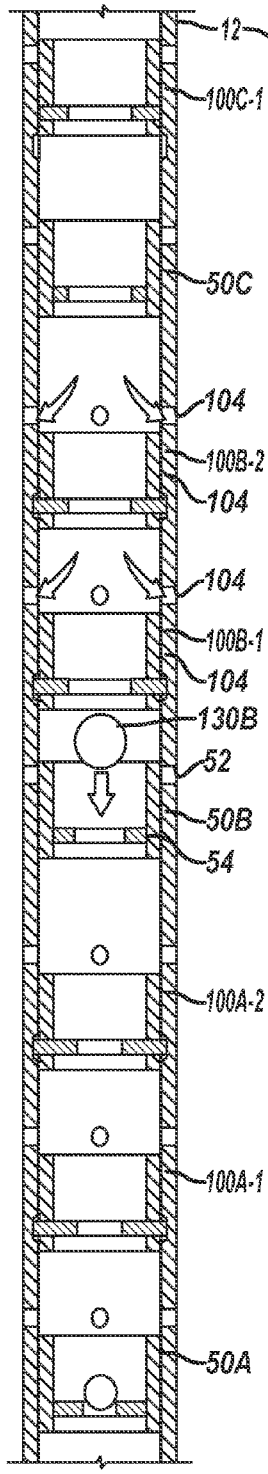
Figure 5C:
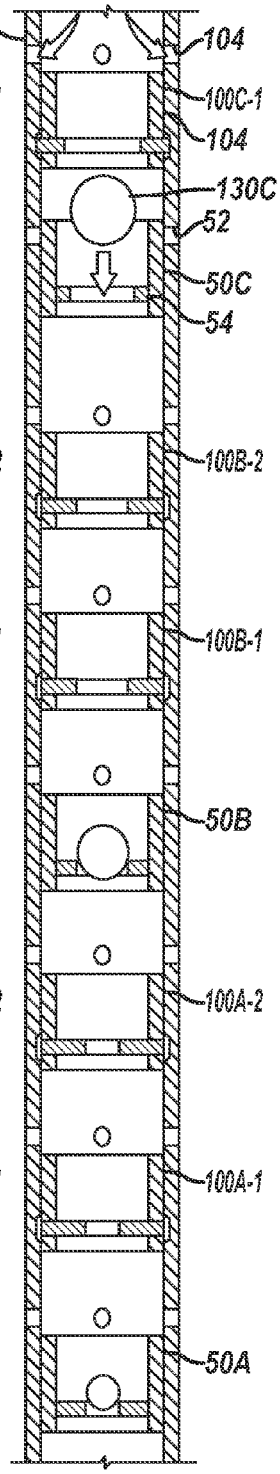

As mentioned previously, several cluster sleeves 100 can be used together on a tubing string and can be used in conjunction with isolation sleeves 50. FIGS. 5A-5C show an exemplary arrangement in which three zones A-C can be separately treated by fluid pumped down a tubing string 12 using multiple cluster sleeves 100, isolation sleeves 50, and different sized balls 130. Although not shown, packers or other devices can be used to isolate the zones A-C from one another. Moreover, packers can be used to independently isolate each of the various sleeves in the same zone from one another, depending on the implementation.

As shown in FIG. 5A, a first zone A (the lowermost) has an isolation sleeve 50A and two cluster sleeves 100A-1 and 100A-2 in this example. These are designed for use with a first ball 130A having a specific size. Because this first zone A is below sleeves in the other zones B-C, the first ball 130A has the smallest diameter so it can pass through the upper sleeves of these zones B-C without opening them. As depicted, the dropped ball 130A has passed through the isolation sleeves 50B/50C and cluster sleeves 100B/100C in the upper zones B-C. At the lowermost zone A, however, the dropped ball 130A has opened first and second cluster sleeves 100A-1/100A-2 according to the process described above and has traveled to the isolation sleeve 50A. Fluid pumped down the tubing string can be diverted out the ports 106 in these sleeves 100A-1/100A-2 to the surrounding annulus for this zone A.

In a subsequent stage shown in FIG. 5B, the first ball 130A has seated in the isolation sleeve 50A, opening its ports 56 to the surrounding annulus and sealing fluid communication past the seated ball 130A to any lower portion of the tubing string 12. As depicted, a second ball 130B having a larger diameter than the first has been dropped. This ball 130B is intended to pass through the sleeves 50C/100C of the uppermost zone C, but is intended to open the sleeves 50B/100B in the intermediate zone B.

As shown, the dropped second ball 130B has passed through the upper zone C without opening the sleeves. Yet, the second ball 130B has opened first and second cluster sleeves 100B-1/100B-2 in the intermediate zone B as it travels to the isolation sleeve 50B. Finally, as shown in FIG. 5C, the second ball 130B has seated in the isolation sleeve 50B, and a third ball 130C of an even greater diameter has been dropped to open the sleeves 50C/100C in the upper most zone C.

The arrangement of sleeves 50/100 depicted in FIGS. 5A-5C is illustrative. Depending on the particular implementation and the treatment desired, any number of cluster sleeves 100 can be arranged in any number of zones. In addition, any number of isolation sleeves 50 can be disposed between cluster sleeves 100 or may not be used in some instances. In any event, by using the cluster sleeves 100, operators can open several sleeves 100 with one-sized ball to initiate a frac treatment in one cluster along an isolated wellbore zone.

The arrangement in FIGS. 5A-5C relied on consecutive activation of the sliding sleeves 50/100 by dropping ever increasing sized balls 130 to actuate ever higher sleeves 50/100. However, depending on the implementation, an upper sleeve can be opened by and pass a smaller sized ball while later passing a larger sized ball for opening a lower sleeve. This can enable operators to treat multiple isolated zones at the same time, with a different number of sleeves open at a given time, and with a non-consecutive arrangement of sleeves open and closed.

Figure 6:
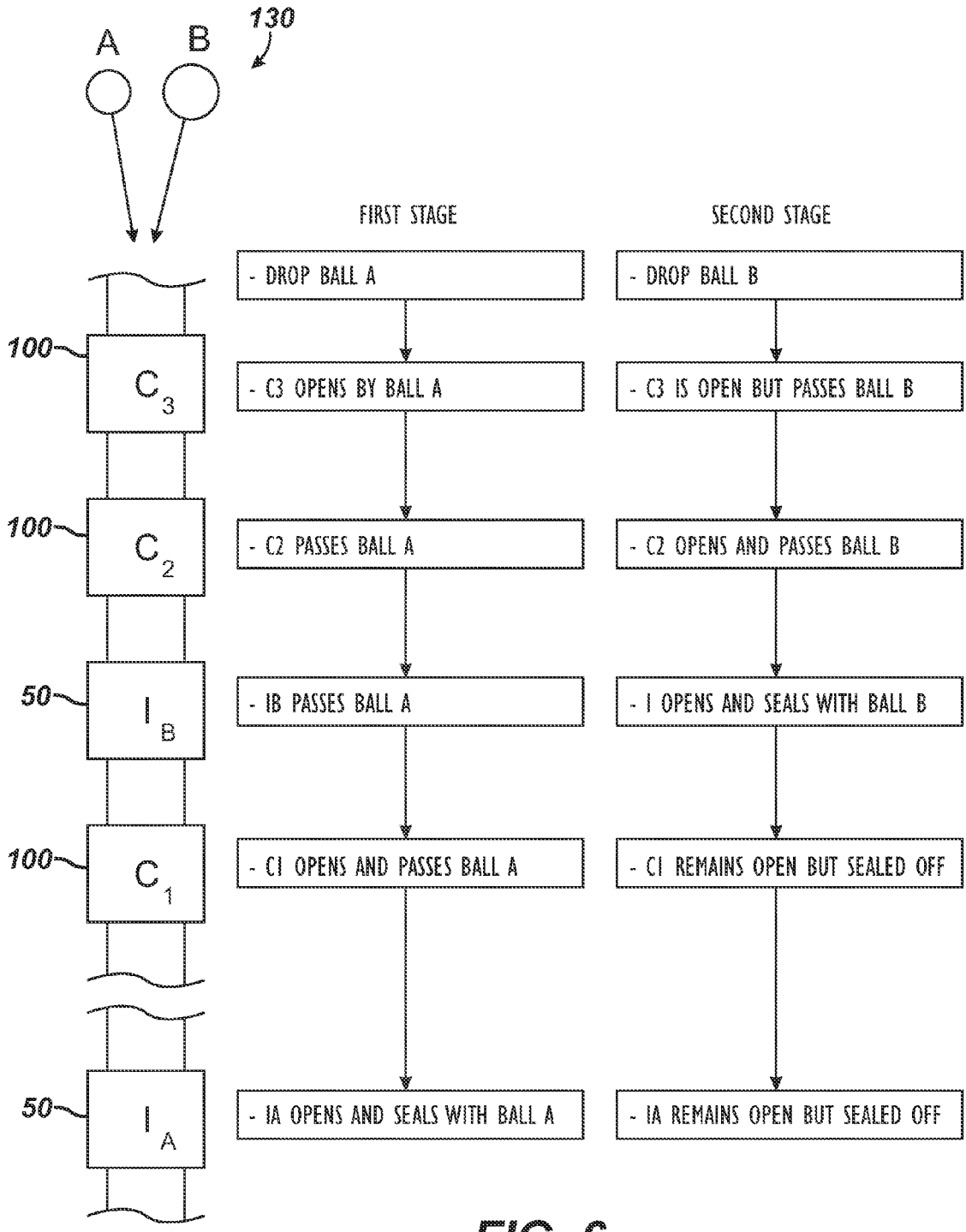
FIG. 6 schematically illustrates another arrangement of cluster sliding sleeves and isolation sliding sleeves in various stages of operation.

For example, FIG. 6 schematically illustrates an arrangement of sliding sleeves 50/100 with a non-consecutive form of activation. The cluster sleeves 100(C1-C3) and two isolation sleeves 50(IA & IB) are shown deployed on a tubing string 12. Dropping of two balls 130(A & B) with different sizes are illustrated in two stages for this example. In the first stage, operators drop the smaller ball 130(A). As it travels, ball 130(A) opens cluster sleeve 100(C3), passes through cluster sleeve 100(C2) without engaging its seat for opening it, passes through isolation sleeve 50(IB) without engaging its seat for opening it, engages the seat in cluster sleeve 100(C1) and opens it, and finally engages the isolation sleeve 50(IA) to open and seal it. Fluid treatment down the tubing string after this first stage will treat portion of the wellbore adjacent the third cluster sleeve 100(C3), the first cluster sleeve 100(C1), and the lower isolation sleeve 50(IA).

In the second stage, operators drop the larger ball 130(B). As it travels, ball 130(B) passes through open cluster sleeve 100(C3). This is possible if the tolerances between the dropped balls 130(A & B) and the seat in the cluster sleeve 100(C3) are suitably configured. In particular, the seat in sleeve 100(C3) can engage the smaller ball 130(A) when the C3's insert has the closed condition. This allows C3's insert to open and let the smaller ball 130(A) pass therethrough. Then, C3's seat can pass the larger ball 130(B) when C3's insert has the opened condition because the seat's key are retracted.

After passing through the third cluster sleeve 100(C3) while it is open, the larger ball 130(B) then opens and passes through cluster sleeve 100(C2), and opens and seals in isolation sleeve 50(IB). Further downhole, the first cluster sleeve 100(C1) and lower isolation sleeve 50(IA) remain open by they are sealed off by the larger ball 130(B) seated in the upper isolation sleeve 50(IB). Fluid treatment at this point can treat the portions of the formation adjacent sleeves 50(IB) and 100(C2 & C3).

As this example briefly shows, operators can arrange various cluster sleeves and isolation sleeves and choose various sized balls to actuate the sliding sleeves in non-consecutive forms of activation. The various arrangements that can be achieved will depend on the sizes of balls selected, the tolerance of seats intended to open with smaller balls yet pass one or more larger balls, the size of the tubing strings, and other like considerations.

For purposes of illustration, a deployment of cluster sleeves 100 can use any number of differently sized plugs, balls, darts or the like. For example, the diameters of balls 130 can range from 1-inch to 3¾-inch with various step differences in diameters between individual balls 130. In general, the keys 142 when extended can be configured to have ⅛-inch interference fit to engage a corresponding ball 130. However, the tolerance in diameters for the keys 142 and balls 130 depends on the number of balls 130 to be used, the overall diameter of the tubing string 12, and the differences in diameter between the balls 130.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole sliding sleeve, comprising:

a housing defining a bore and defining a port communicating the bore outside the housing;

an insert disposed in the bore and being movable from a closed condition to an opened condition, the insert in the closed condition preventing fluid communication between the bore and the port, the insert in the opened condition permitting fluid communication between the bore and the port;

a seat movably disposed in the insert, the seat when the insert is in the closed condition extending at least partially into the bore and engaging a plug disposed in the bore to move the insert from the closed condition to the opened condition, the seat when the insert is in the opened condition retracting from the bore and releasing the plug; and an inset member being temporarily disposed in the port, the inset member at least temporarily maintaining fluid pressure in the bore and allowing the maintained fluid pressure to act against the plug and open at least one additional downhole sliding sleeve.

2. The sliding sleeve of claim 1, wherein the insert defines slots, and wherein the seat comprises a plurality of keys movable between extended and retracted positions in the slots.

3. The sliding sleeve of claim 1, wherein the plug comprises a ball.

4. The sliding sleeve of claim 1, wherein the insert comprises seals disposed thereon and sealing off the port when the insert is in the closed condition.

5. The sliding sleeve of claim 1, wherein the bore comprises seals disposed on either side of the port and sealing against the insert when in the closed condition.

6. The sliding sleeve of claim 1, further comprising a catch temporarily holding the insert in the closed condition.

7. The sliding sleeve of claim 6, wherein the catch comprises a shear ring engaging an end of the insert in the closed condition.

8. The sliding sleeve of claim 1, further comprising a lock locking the insert in the opened condition.

9. The sliding sleeve of claim 8, wherein the lock comprises a snap ring disposed about the insert and expandable into a slot in the bore when the insert is in the opened condition.

10. The sliding sleeve of claim 1, wherein the inset member defines an orifice communicating the bore outside the housing through the inset member, the orifice producing a pressure differential across the insert in the closed condition and facilitating movement of the insert from the closed condition to the opened condition.

11. The sliding sleeve of claim 1, wherein the inset member dislodges from the port when subjected to fluid pressure for a frac operation in the bore.

12. A downhole well fluid system, comprising:

first cluster sleeves disposed on a tubing string deployable in a wellbore, each of the first cluster sleeves being actuatable by a first plug deployable down the tubing string, each of the first cluster sleeves being actuatable from a closed condition to an opened condition, the closed condition preventing fluid communication between a port in the first cluster sleeve and the wellbore, the opened condition permitting fluid communication between the port in the first cluster sleeve and the wellbore, each of the first cluster sleeves in the opened condition allowing the first plug to pass therethrough, and each of the first cluster sleeves having an inset member being temporarily disposed in the port, the inset member for a given one of the first cluster sleeves at least temporarily maintaining fluid pressure in the bore and allowing the maintained fluid pressure to act against the first plug at least until the first cluster sleeves are opened.

13. The system of claim 12, wherein the first plug comprises a ball.

14. The system of claim 12, wherein each of the first cluster sleeves comprises:

a housing defining a bore and defining the port communicating the bore outside the housing;

an insert disposed in the bore and being movable from the closed condition to the opened condition, the insert in the closed condition preventing fluid communication between the bore and the port, the insert in the opened condition permitting fluid communication between the bore and the port; and a seat movably disposed in the insert, the seat when the insert is in the closed condition extending at least partially into the bore and engaging a plug disposed in the bore to move the insert from the closed condition to the opened condition, the seat when the insert is in the opened condition retracting from the bore and releasing the plug.

15. The system of claim 12, further comprising an isolation sleeve disposed on the tubing string and being actuatable from a closed condition to an opened condition, the closed condition preventing fluid communication between the isolation sleeve and the wellbore, the opened condition permitting fluid communication between the isolation sleeve and the wellbore, the isolation sleeve having a seat engaging the first plug and preventing fluid communication therepast.

16. The system of claim 12, further comprising:

second cluster sleeves disposed on the tubing string, each of the second cluster sleeves being actuatable by a second plug deployed down the tubing string, each of the second cluster sleeves being actuatable from a closed condition to an opened condition, the closed condition preventing fluid communication between the second cluster sleeve and the wellbore, the opened condition permitting fluid communication between the second cluster sleeve and the wellbore, each of the second cluster sleeves in the opened condition allowing the second plug to pass therethrough.

17. The system of claim 16, wherein each of the second cluster sleeves pass the first plug therethrough without being actuated.

18. The system of claim 16, further comprising an isolation sleeve disposed on the tubing string and being actuatable from a closed condition to an opened condition, the closed condition preventing fluid communication between the isolation sleeve and the wellbore, the opened condition permitting fluid communication between the isolation sleeve and the wellbore, the isolation sleeve having a seat engaging the second plug and preventing fluid communication therepast.

19. The system of claim 16, wherein each of the second cluster sleeves comprises an inset member being temporarily disposed in a port of the second cluster sleeves, the inset member for a given one of the second cluster sleeves at least temporarily maintaining fluid pressure in the bore and allowing the maintained fluid pressure to act against the second plug and open at least until the second cluster sleeves are opened.

20. The system of claim 12, wherein the inset member for each of the first cluster sleeves defines an orifice communicating the bore outside the first cluster sleeve through the inset member, the orifice producing a pressure differential across an insert in the closed condition in the first cluster sleeve and facilitating movement of the insert from the closed condition to the opened condition in the first cluster sleeve.

21. The system of claim 12, wherein the inset member for each of the first cluster sleeves dislodges from the port in the first cluster sleeve when subjected to fluid pressure for a frac operation in a bore of the first cluster sleeve.

22. A wellbore fluid treatment method, comprising:

deploying first and second sliding sleeves on a tubing string in a wellbore, each of the sliding sleeves having a closed condition preventing fluid communication between ports in the sliding sleeves and the wellbore;

dropping a first plug down the tubing string;

changing the first sliding sleeve to an open condition allowing fluid communication between the port in the first sliding sleeve and the wellbore by engaging the first plug on a first seat disposed in the first sliding sleeve;

passing the first plug through the first sliding sleeve in the opened condition to the second sliding sleeve: and at least temporarily maintaining fluid pressure in the first sliding sleeve in the opened condition to open at least one additional sliding sleeve with the first plug engaging an additional seat disposed in the at least one additional sliding sleeve by restricting fluid flow through the port with an inset member disposed in the port of the first sliding sleeve.

23. The method of claim 22, wherein the at least one additional sliding sleeve comprises the second sliding sleeve having a second seat as the additional seat, and wherein the method further comprises changing the second sleeve to an open condition allowing fluid communication between the second sliding sleeve and the wellbore by engaging the first plug on the second seat disposed in the second sliding sleeve.

24. The method of claim 23, further comprising passing the first plug through the second sliding sleeve in the opened condition.

25. The method of claim 23, further comprising sealing the first plug on the second seat of the second sliding sleeve and preventing fluid communication therethrough.

26. The method of claim 22, further comprising:

deploying a third sliding sleeve on the tubing string in the wellbore, the third sliding sleeve having a closed condition preventing fluid communication between the third sliding sleeve and the wellbore; and passing the first plug through the third sliding sleeve to the first sliding sleeve without changing the third sliding sleeve from the closed condition.

27. The method of claim 26, further comprising:

dropping a second plug down the tubing string;

changing the third sliding sleeve to an open condition allowing fluid communication between the third sliding sleeve and the wellbore by engaging the second plug on a third seat disposed in the third sliding sleeve.

28. The method of claim 27, further comprising passing the second plug through the third sliding sleeve in the opened condition.

29. The method of claim 28, further comprising changing a fourth sliding sleeve to an open condition allowing fluid communication between the fourth sliding sleeve and the wellbore by engaging the second plug on a fourth seat of the fourth sliding sleeve.

30. The method of claim 27, further comprising sealing the second plug on the third seat of the third sliding sleeve and preventing fluid communication therethrough.

31. The method of claim 22, further comprising:

passing the first plug through the second sliding sleeve without changing the second sliding sleeve from the closed condition;

dropping a second plug down the tubing string;

passing the second plug through the first sliding sleeve in the opened condition; and changing the second sliding sleeve to an open condition by engaging the second plug on a second seat disposed in the second sliding sleeve.

32. The method of claim 31, wherein the second plug has a larger size than the first plug.

33. The method of claim 22, wherein the at least one additional sliding sleeve comprises a third sliding sleeve having a third seat as the additional seat, and wherein the method further comprises changing the third sleeve to an open condition allowing fluid communication between the third sliding sleeve and the wellbore by engaging the first plug on the third seat disposed in the third sliding sleeve.

34. The method of claim 22, further comprising facilitating movement of an insert in the first sliding sleeve from the closed condition to the opened condition relative to the port by producing a pressure differential across the insert in the closed condition with an orifice in the inset member communicating outside the first sliding sleeve.

35. The method of claim 22, further comprising dislodging the inset member from the port in the first sliding sleeve by applying fluid pressure for a frac operation in the first sliding sleeve.

* * * * *